United States Patent [19]

Ikenishi et al.

[11] 4,078,373

[45] Mar. 14, 1978

[54] MARKING DISPLAY ASSEMBLY IN A WATCH MOVEMENT

[75] Inventors: Masataka Ikenishi, Soka; Shozo Kushida, Narashino; Tadahiro Kikuchi, Tokyo; Yukio Ikihata, Matsudo, all of Japan

[73] Assignee: Kabushiki Kaisha Daini Seikosha, Japan

[21] Appl. No.: 609,066

[22] Filed: Aug. 29, 1975

[30] Foreign Application Priority Data

Sep. 3, 1974 Japan ..... 49-106034[U]

[51] Int. Cl.[2] ..... G04F 13/00

[52] U.S. Cl. ..... 58/1 R; 58/23 R

[58] Field of Search ..... 58/23 R, 104, 1 R, 59, 58/57; 317/99, 101 B, 101 C, 101 CM, 101 F; D30/43; 174/68.5; 40/2 R, 2.2, 104.19, 21 C, 10 R, 63 A, 312, 333, 21 C

[56] References Cited

U.S. PATENT DOCUMENTS

| | | | |
|---|---|---|---|
| 819,568 | 5/1906 | Manthey | 58/59 |
| 1,851,491 | 3/1932 | Brown | 40/21 C |
| 1,997,511 | 4/1935 | Canepa | 58/58 |
| 3,187,449 | 6/1965 | Longo et al. | 40/10 R |
| 3,228,128 | 1/1966 | Sharp | 40/2.2 |
| 3,291,374 | 12/1966 | Lepisto et al. | 40/2 R X |
| 3,645,086 | 2/1972 | Niznik | 58/58 X |
| 3,650,599 | 3/1972 | Pedersen | 58/50 R X |
| 3,757,511 | 9/1973 | Burgess et al. | 58/50 R |
| 3,838,568 | 10/1974 | Zurcher et al. | 58/50 R X |
| 3,866,407 | 2/1975 | Wuthrich | 58/58 |
| 3,939,645 | 2/1976 | Charbonney | 58/58 X |

FOREIGN PATENT DOCUMENTS

| | | | |
|---|---|---|---|
| 453,298 | 1/1913 | France | 58/127 |

OTHER PUBLICATIONS

"Universal Engineer," Waterbury Watch, Oct. 8, 1884, p. 230.

Zodiac Ad from "Incentive Marketing" p. 213, Jan. 1971.

*Primary Examiner*—Ulysses Weldon

*Attorney, Agent, or Firm*—Robert E. Burns; Emmanuel J. Lobato; Bruce L. Adams

[57] ABSTRACT

A watch movement comprises upper and lower spaced-apart plates between which are mounted the major components of the watch movement. Manufacturing indicia indicative of the manufacturer, date, serial number and other particulars of the watch movement are disposed on the top face of the lower plate, facing the upper plate, and corresponding openings are provided in the upper plate overlying the indicia so that the manufacturing indicia is readily visible through the openings. Magnifying lenses may be disposed over the openings to magnify the indicia visible therethrough.

3 Claims, 3 Drawing Figures

MARKING DISPLAY ASSEMBLY IN A WATCH MOVEMENT

BACKGROUND OF THE INVENTION

This invention relates to a marking display assembly in a watch movement.

Nowadays, it is required that the name of the watch maker, the place of production, symbols, figures and other manufacturing indicia be marked in the inner portion of a watch movement such that they can be read from the upper part of the watch movement. As a consequence, considerable difficulties have been encountered in manufacturing watch parts having such marks. In particular, since these marks on a circuit base plate are effected by a pattern etching technique, it is necessary that the marks take up a large space because small marks are not easily read. However, the space is limited. And further, if the display mark is too large so as to be easily read though the space between adjacent lead conductors on the circuit base plate, there occurs the disadvantage that is stray capacity increases between the conductors and insulation resistance decreases.

SUMMARY OF THE INVENTION

It is therefore an object of the present invention to eliminate the above-mentioned drawbacks and to provide an improvement of a marking display assembly in a watch movement where certain display marks or manufacturing indicia are marked on a lower bridge plate or a lower circuit base plate and read through an opening plate in an upper bridge or an upper circuit base plate, whereby it is possible to maintain a suitable space between the lead conductors.

DETAILED DESCRIPTION OF THE INVENTION

The present invention will be fully described by way of the embodiment in connection with the accompanying drawings.

Figure 1:
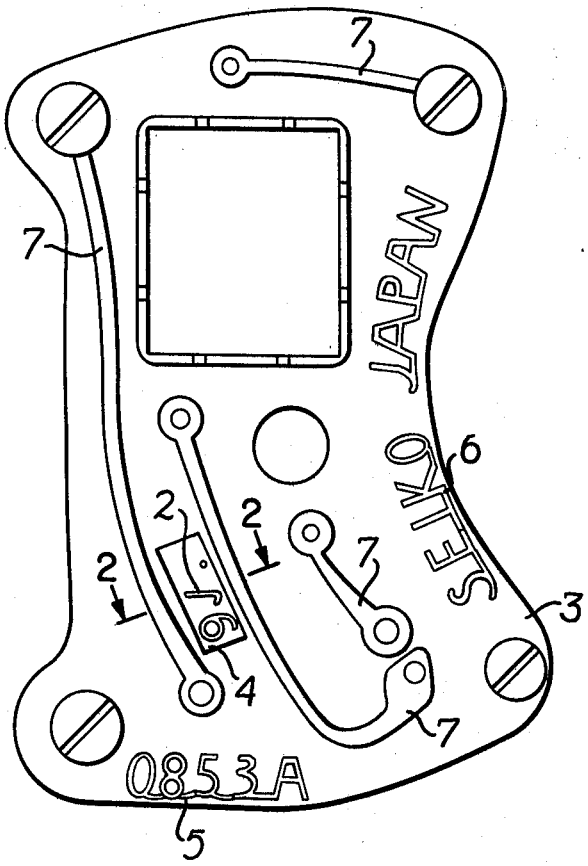
FIG. 1 is a top plan view showing an embodiment of the present invention.
Figure 2:
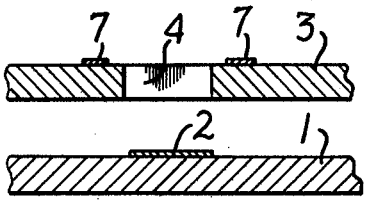
FIG. 2 is a sectional view taken on the line A—A in FIG. 1.

As seen in FIGS. 1 and 2, a display mark 2 is marked on an upper surface of a lower bridge plate 1. An upper bridge plate or circuit base plate 3 is disposed above the lower bridge plate 1 and is provided with an opening 4 in a portion thereof overlying the display mark 2 on the lower bridge plate 1. Other display marks 5 and 6 are respectively marked on the circuit base plate 3 by pattern etching, and a pattern of lead conductors 7 are disposed on the same plate 3.

It is to be noted that the display mark 2 on the lower bridge plate 1 is read through the opening 4 of the upper circuit base plate 3. By such a construction, it is possible to avoid the increment of a stray capacitance which is otherwise apt to occur when the display mark is disposed on the base plate 3 in a narrow space between two adjacent lead conductors. Further, the effect of the marking display according to the inventive construction does not vary and it is easily and clearly visible.

Figure 3:
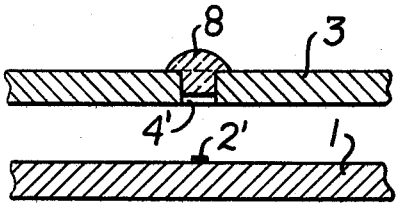
FIG. 3 is a sectional view showing a main part of another embodiment of the present invention.

FIG. 3 shows another embodiment of the present invention, where the upper circuit base plate 3 is provided with an opening 4' which is relatively small. A lens 8 is put in the opening 4' to magnify a small display mark 2' which is disposed on the lower bridge plate 1, whereby the display mark is easily read through the lens 8 over the small opening 4'.

According to a construction which is assembled as mentioned above, the indispensable manufacturing data indica or display marks may be marked in an optional portion in spite of the narrow space of the circuit base plate, or the like.

In addition, the display mark is not restricted by the mark described in the above embodiment, and other manufacturing data indicia such as the name of the watch manufacturer, symbols, figures, or other marks may be included.

Moreover, the display mark may be marked on a base plate or a lower circuit base plate in place of the lower bridge plate while the opening may be formed in an upper bridge plate in place of the upper circuit base plate.

As mentioned above, according to the present invention, many advantages are brought about. For example, it is possible to avoid placing a large number of marks on the upper circuit bridge plate or the like where the space is restricted. Moreover, since the display mark is disposed on the lower bridge plate or the like instead of in a narrow space between lead conductors on the upper circuit base plate or the like the display mark can be easily read through the opening formed on the upper circuit base plate or the like, thereby avoiding the build up of the stray capacity and the decrement of the insulation resistance between conductors. Therefore, the practical use of the present invention is very large.

What is claimed is:

1. In a watch movement of the type having upper and lower plates superposed and spaced apart from each other: a pattern of lead conductors on one surface of said upper plate; means defining manufacturing data indicia indicative of the type watch movement disposed on the top surface of said lower plate facing said upper plate; and means defining an opening extending through said upper plate at a location overlying said manufacturing data indicia so that said manufacturing data indicia is visible through said opening, said opening extending through said upper plate adjacent at least one of said lead conductors thereby avoiding build-up of stray capacitance which would otherwise occur if said manufacturing data indicia was disposed directly on said upper plate adjacent said at least one of said lead conductors.

2. A watch movement according to claim 1; including means defining additional manufacturing data indicia on the top surface of said upper plate.

3. A watch movement according to claim 1; including a magnifying lens disposed over said opening to effectively magnify the manufacturing data indicia viewed through said opening.

* * * * *